US005603859A

United States Patent [19]

Wallis

[11] Patent Number: 5,603,859

[45] Date of Patent: Feb. 18, 1997

[54] VESSEL OUTLET

[75] Inventor: Roger Wallis, Sheffield, England

[73] Assignee: Foseco International Limited, Birmingham, England

[21] Appl. No.: 84,209

[22] PCT Filed: Jan. 14, 1992

[86] PCT No.: PCT/GB92/00080

§ 371 Date: Jul. 6, 1993

§ 102(e) Date: Jul. 6, 1993

[87] PCT Pub. No.: WO92/12815

PCT Pub. Date: Aug. 6, 1992

[30] Foreign Application Priority Data

Jan. 18, 1991 [GB] United Kingdom ..... 9101172
Dec. 3, 1991 [GB] United Kingdom ..... 9125698

[51] Int. Cl.[6] ..... B22D 41/08

[52] U.S. Cl. ..... 222/598; 222/594; 266/236

[58] Field of Search ..... 266/236; 222/591, 222/594, 597, 598, 599

[56] References Cited

U.S. PATENT DOCUMENTS

| | | | |
|---|---|---|---|
| 3,651,998 | 3/1972 | Rocher | 222/598 |
| 3,760,992 | 9/1973 | Bieri | 222/598 |
| 4,200,210 | 4/1980 | Riegler et al. | 222/598 |
| 4,840,295 | 6/1989 | Hartley | 222/598 |
| 4,932,570 | 6/1990 | Gimpera | 222/598 |

FOREIGN PATENT DOCUMENTS

| | | |
|---|---|---|
| 0165292 | 2/1950 | Australia . |
| 0310296 | 9/1988 | European Pat. Off. . |
| 2140597 | 6/1972 | France . |
| 0631753 | 3/1934 | Germany . |
| 3842121 | 6/1989 | Germany . |
| 3743383 | 7/1989 | Germany . |
| 63-256265 | 4/1987 | Japan . |
| 1367425 | 9/1974 | United Kingdom . |
| 2226263 | 6/1990 | United Kingdom . |
| WO88/05355 | 7/1988 | WIPO . |
| WO90/14907 | 12/1990 | WIPO . |

*Primary Examiner*—Scott Kastler
*Attorney, Agent, or Firm*—Nixon & Vanderhye P.C.

[57] ABSTRACT

A rotary valve for use in the release of a molten solid from a vessel comprises a valve member having a passage, inlets to the passage being present in the head of the member. The valve member mates with a wall of a seating member, the wall having a taller first section and a lower second section selected to close off or open the inlets, respectively. The wall portions are shaped relative to the surfaces of the member to avoid metal freezing and the parts sticking. The passage includes ribs to cause the stream to emerge with parallel sides.

9 Claims, 3 Drawing Sheets

VESSEL OUTLET

BACKGROUND AND SUMMARY OF THE INVENTION

This invention relates to the casting of molten metal and in particular to vessels for molten solids, e.g. molten metal, and to outlets for said vessels.

Problems occur when molten solids are poured through an outlet from a vessel, for example when pouring molten metal. In a foundry, it is known to fit an outlet through the floor of a vessel for molten metal, e.g. a foundry ladle, and to provide a so-called stopper rod above the vessel. The rod is lowered or raised to close or open the outlet. The rod comprises a metal shaft surrounded by a refractory sleeve. This arrangement has disadvantages. For example, the rod becomes distorted in use; if it is used as a throttle, the stream of metal breaks up affecting the quality of the casting; and there is a relatively long turn around period when changing the refractory sleeve of the stopper rod.

An alternative device is a so-called sliding gate valve. This is mounted externally below the bottom outlet and is used on bulk steel ladles where the liquid metal is discharged in a few pours. In the foundry, however, the outlet is opened and closed a greater number of times and there can be long intervals between one opening and the next. When the sliding gate valve is closed, a slug of metal forms in the outlet above the closed valve and is unable to circulate, even though it is communication with the bulk of the molten metal, and the slug tends to freeze if the time between successive pours is too great. This causes metal to freeze on the sliding gate valve which is thus not suitable for use with foundry ladles. The sliding gate valve is also not without problems in relation to liquid steel which is particularly prone to this "freezing-off" and there is thus a serious risk of valve blockage.

It has been realised that there should be advantages in having a rotary valve mechanism instead of a stopper rod system or a sliding gate valve system. The mechanism comprises a valve in a seating therefor in the vessel outlet. A passage is present in the valve member which has inlets in the head portion thereof. A drive mechanism is present outside the vessel and used to rotate the valve member with respect to the seating member therefor, the seating member being shaped so that when in one position the inlet is closed off and in another open. Such a system is disclosed in WO88/05355 published in July 1988; in GB-A-2226263 published in June 1990; and in WO 90/14907 published in December 1990. More specifically, GB-A-2226263 discloses an outlet comprising a rotary valve member and a seating therefor, the valve member having at least one passage for conducting molten solid from inside to outside the vessel, the valve member sealing with a wall of the seating member, the wall having a first section sufficiently high that when the valve member is rotated to align an inlet end of the passage therewith the passage is closed by the first section, the wall having a second section of less height so that if the valve member is rotated to align the inlet end of the passage therewith, the inlet end is open. The outlet is normally installed so that the top of the second section of the wall is level with the inside surface of the floor of the vessel. The first section does not extend round the periphery of the wall significantly further than necessary to close the outlet. The majority of the valve member is therefore exposed so that, in contrast to the conditions when a sliding gate valve is closed, the molten metal is able to circulate around the closed valve member and there is no slug of trapped metal liable to freeze between pours.

In each of these prior disclosures, insufficient attention has been paid to the practical problems of operating such a rotary valve mechanism. It has now been discovered that in order to reliably and repeatedly rotate the valve member it is necessary to shape the sealing faces as described herein and arrange the valve so that there are no dead zones wherein molten solid can be trapped; and preferably also shape the exit portion of the passage so that the stream of molten solid emerges in a predetermined shade.

In one aspect the invention provides an outlet for a vessel containing molten solid, the outlet comprising a rotary valve member and a seating member therefor, the valve member having a passage to conduct molten solid from inside to outside the vessel, the valve member sealing with a wall of the seating member, the wall having a first section sufficiently high so that when the valve member is rotated to align an inlet end of the passage therewith the inlet end is closed by the first section, the wall having a second section of relatively reduced height so that when the valve member is rotated to align an inlet end of the passage therewith the inlet end is open to allow molten solid to pass into and along the passage characterised in that the first section of the wall provides upstanding side walls for the second section whereby the second section provides the base of a generally open channel cross-sectional shape so that molten solid can pass freely in the region of the second section when the inlet is closed, and in that the opposite surfaces of the valve member and the wall of the sealing member which mate are convex in a plane including the axis of rotation of the valve member to reduce sticking in use.

Thus, because the first section provides upstanding side walls for the second section which defines the base of a channel of generally open cross-sectional shape, i.e. no roof is present, there is reduced risk of creating a dead zone in which molten solid can settle to solidify. Preferably, the sidewalls of the second section lie along planes which diverge outwardly away from the valve member to avoid a restriction of the flow of molten solid and to discourage any bridging which might otherwise lead to a solidification of the molten solid. Furthermore, in the known outlets the valve member and the seating member have conical surfaces which mate to form a seal. In use the valve member tends to stick leading to the need for large forces to rotate it, which leads to wear. However, in accordance with the present invention, the surfaces are convex in a plane including the axis of rotation of the valve member. This prevents the jamming experienced with conical members reducing the force required to rotate the valve member and generally decreasing wear and thus increasing robustness. Also, if the sealing surfaces are hemispherical the same benefits accrue and the valve assembly can tolerate slight misalignments of the refractory parts. This will be of considerable benefit in industries where unskilled labour is employed, e.g. in the steel and iron industries.

In accordance with an alternative or additional aspect of the invention, the outlet has a branched passage which has a plurality of outlet ends spaced from each other so as to be aligned with the second section of the wall in different rotational positions of the valve member, the inlet ends communicating with a common outlet end of the passage. If, in use the valve member is always rotated in the same direction, both to open and close the passage, each of the inlet ends will be used in turn, so reducing the wear and tear on each and increasing the life of the outlet.

The dimensions of the sections depend on the number of inlets and whether they are to be used singly or together..

Where there is a single inlet and a single second section, the first section preferably comprises from about 19% to about 81% of the length of the wall. Where there are two inlets and two second sections the first section preferably comprises from about 38% to about 62% of the length of the wall. Where there are two inlets and a single second section so that the inlets are used individually preferably the first section comprises from about 69% to about 81% of the length of the wall. The number of inlets may exceed two. The dimensions given are preferred in the case of casting articles of steel in a foundry, and other values may be appropriate when the molten solid is different, e.g. or another metal such as iron, or steel when processed in a steelmill or a A suitable material from which to form an outlet intended for a metallurgical vessel, is graphitised alumina and the valve member and seating member are preferably made by isostatic pressing. Although a preferred embodiment of the invention is utilised in a vessel for molten metal, the invention can be applied to a vessel for any molten solid which is liable to freeze blocking the outlet.

It is a much preferred feature of the invention that the flow of molten metal emerging from the down pipe be coherent, i.e. having substantially parallel sides, irrespective of the extent of opening of the inlet. To ensure this, in a further feature of the invention, means to control the shape of the stream are present in the passage. Most preferably the means comprises elongate generally parallel straight sided ribs, radially spaced about the passage. Preferably at least two such ribs are present.

The invention also extends to a vessel for molten solids having a floor having an opening containing an outlet as defined in this invention, the top of the second section of the wall of the outlet being approximately level with that of the surface of the floor inside the vessel.

BRIEF DESCRIPTION OF THE DRAWINGS

One embodiment of the invention will now be described with reference to the accompanying drawings, in which.

DETAILED DESCRIPTION OF THE DRAWINGS

Figure 5:
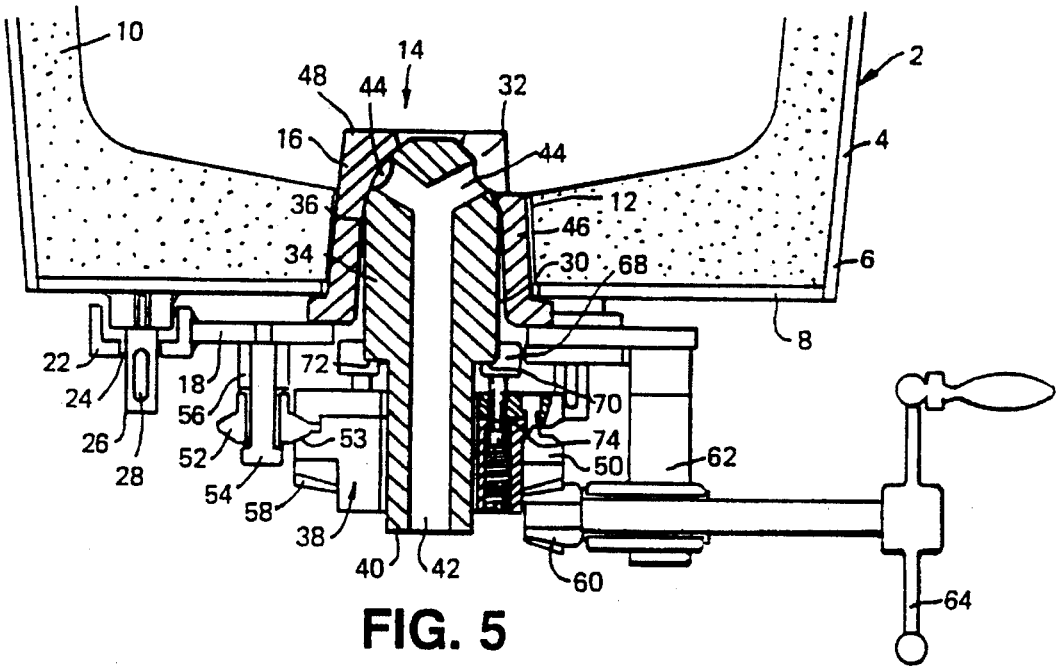
FIG. 5 is a section on arrows V-V of FIG. 2 showing the outlet installed in a foundry ladle.
Figure 6:
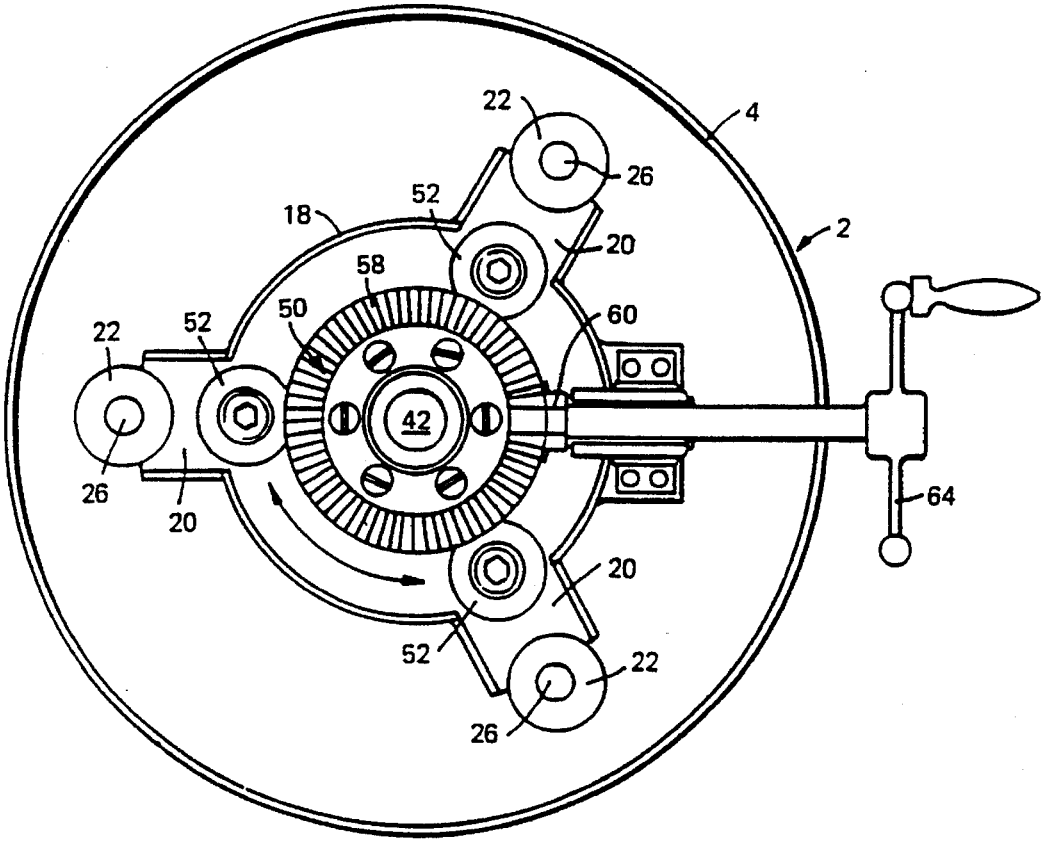
FIG. 6 is a view from underneath the foundry ladle shown in FIG. 5.

Referring to the drawings, a vessel comprises a foundry ladle 2 (FIGS. 5 and 6), having an outer metal shell 4 defining a side wall 6 and a floor 8. The shell has a refractory lining 10. A hole 12 having a conical taper extends through the floor 8 of the shell and of the lining. An outlet 14 has a seating member 16 which has an exterior frustoconical surface matching that of the hole 12, is retained therein by an annular plate 18. The plate 18 has three arms 20 projecting radially therefrom. A cup 22 is mounted at the end of each arm 20. The plate 18 is located by bosses 26 which depend from the floor 8 of the ladle, and which extend through central holes through each cup 22. A wedge (not shown) is driven through a slot 28 in each boss to retain the seating member 16 tightly in the hole 12.

A tapered hole 30 opens through the seating member 16 into the ladle 2 so that the seating member defines a wall 32 about the hole 30. A valve member 34 has a side surface 36 which mates sealingly with the tapered hole 30 at its inner end. The valve member 34 is retained in, and is rotatable by, a mechanism generally indicated at 38. The wall 32 and the mating surface 36 of the valve member are convex in a plane including the axis of rotation of the valve member. This reduces the tendency to stick which would occur if the surfaces were conical.

At its lower end, the valve member 34 provides a nozzle 40, of reduced section, having a central passage 42 which communicates branches at the upper end to communicate with a plurality of inlets 44. In the example illustrated there are two inlets 44 in opposite side surfaces of the valve member 34.

Figure 1:
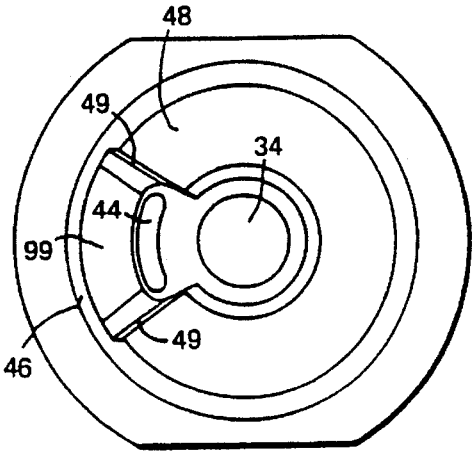
FIG. 1 is a plan view of an outlet embodying the invention.
Figure 3:
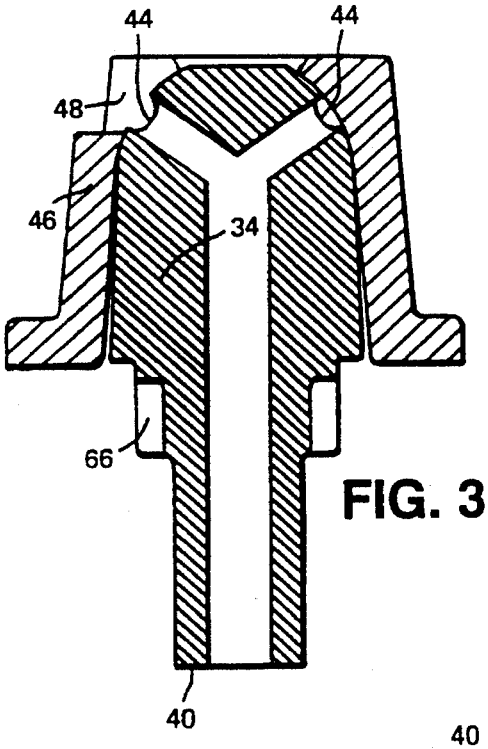
FIG. 3 is a side view in section of the outlet, at right angles to that of FIG. 2.

The wall 32 is of non-uniform height. A second section 46 of the wall is of such a height that its top is approximately level with the top of the lining 10 on the floor of the ladle. When the valve member is rotated to the position illustrated in FIGS. 3 and 5, the inlet end 44 of the passage is open so that molten metal may flow from the ladle. Another (first) section 48 of the wall 32 is taller and of such a height that when an inlet end of the passage is aligned therewith, the inlet is closed thereby. This condition may be seen on the left-hand side of FIGS. 3 and 5 so that only one of the inlets is open. The section 48 of the wall extends round sufficient of the periphery of the wall that, when the valve member is rotated to a position at 90 degrees to that shown in FIGS. 3 and 5, both inlets 44 are closed. As can be seen in FIG. 1, the walls of the taller section 48 define the sidewalls of the channel 99 whose base is defined by the top of the lower section of wall 46. The channel 99 is of generally open cross-sectional shape, i.e. having no roof. The sidewalls 49 of the channel lie along planes which diverge apart away from the valve member 34. In other words, the shape of the second section 46 is open and free of walls or shoulders which could provide blind alleys or dead zones.

In a variation, not illustrated, the passage has only one inlet end opening through its side surface 36. In such a case the higher section 48 extends around at least 19% of the periphery of the wall. In the case illustrated, the higher section 48 must extend round more than 69%, sufficient to close both inlets together. In either case, it is preferred, for robustness, that the higher section extends round as much of the wall as practicable, and more preferably that the lower section 46 extends along the periphery of the wall approximately the same distance as the inlet end 44 of the passage.

In the example illustrated, the section 46 extends round only a small portion of the periphery of the wall sufficient that the inlet can be completely uncovered. When the inlets are closed, despite the fact that the section 48 extends round the majority of the wall, molten metal is able to circulate under the effect of convection currents around all the exposed surfaces of the valve member 34 so reducing the tendency of metal to freeze on the valve member. (Contrast this with the situation if instead of the wall 32 having a low section 46, the wall was formed with a through hole bound by walls all round, for example similar to the arrangement disclosed in WO 88/05355. Although in the latter case molten metal would flow satisfactorily through the hole when the valve was open, when the valve was closed, there would be a slug of metal trapped in the hole and, although in communication with the bulk of the molten metal, the slug would be unable to circulate into the bulk, and additionally the area of cooling surface is greater so that the molten metal would tend to freeze by heat loss due to conduction through the valve member).

In contrast to the prior stopper rod arrangement the outlet illustrated may be partially closed, to throttle the flow of molten metal, without the stream dividing. The operator has improved control over the pouring rate, and the nozzle size may vary up to the full bore to suit the size of the product. The ladle may be covered to reduce temperature losses (because there is no top apparatus to move the stopper rod) and metallurgical treatment may be conducted without the risk of melting a stopper rod. In contrast to a sliding gate arrangement there are no dead zones in which metal may solidify prematurely.

Another advantage of the invention is that it is possible to control or regulate the flow of the liquid from the outlet and maintain stream integrity.

The mechanism 38 comprises an annular ring gear 50 mounted for rotation by three V-section rollers 52 each of which is rotatably mounted on the plate 18 by a shaft 54 and spaced from the plate by a spacer 56. The V-section rollers are received by a V-section slot 53 in the periphery of the ring gear so allowing the gear to rotate. The lower face of the ring gear is formed with bevelled gear teeth 58 which engage a bevel gear 60 mounted on a shaft journalled in a bracket 62, mounted on the plate 18, for rotation by a handwheel 64. Rotation of the handwheel 64 thus drives the ring gear to rotate.

Figure 2:
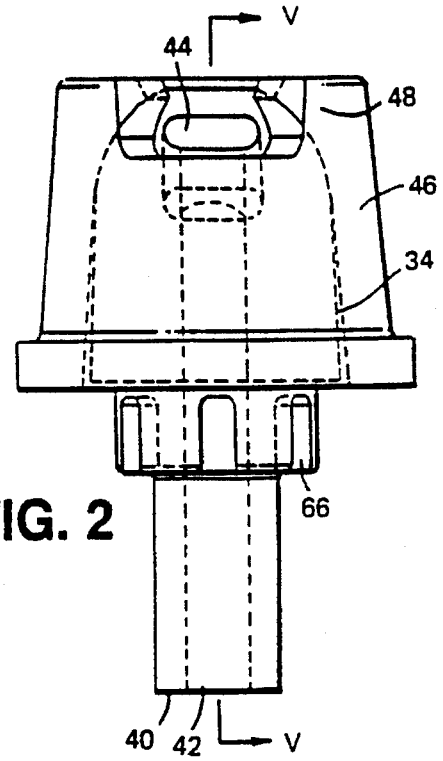
FIG. 2 is a side view of the outlet of FIG. 1.
Figure 4:
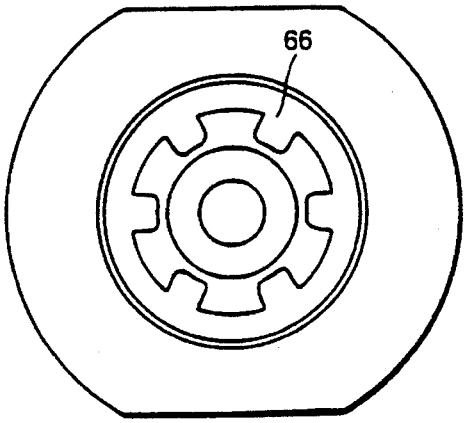
FIG. 4 is a view from below of FIG. 3.

Referring to FIG. 4, above a shoulder 70, the valve member is formed with a plurality of indents 66 around its periphery. An annular pressure plate 68 is formed with a recess 72 to receive the shoulder 70. The pressure plate 68 is urged against the shoulder 70 by a plurality (six are illustrated) of spring loaded pressure pins 74 which extend from respective bores in the ring gear 50 so urging the valve member into its sealing engagement with the seating member 16. The pressure plate 68 has a plurality of teeth (not shown) which extend inwardly into the recess 72 so as to engage in the indents 66 so that rotation of the ring gear causes rotation of the valve member. The indents 66 extend axially of the valve member (see FIGS. 2 and 3) a sufficient distance that no axial thrust is transmitted to the valve member by the teeth so avoiding high local pressures.

In order to withstand the temperatures associated with molten metals or alloys, the valve member and seating member are both formed of a refractory material, eg graphitised alumina which may be formed by isostatic pressing.

Figure 7A:
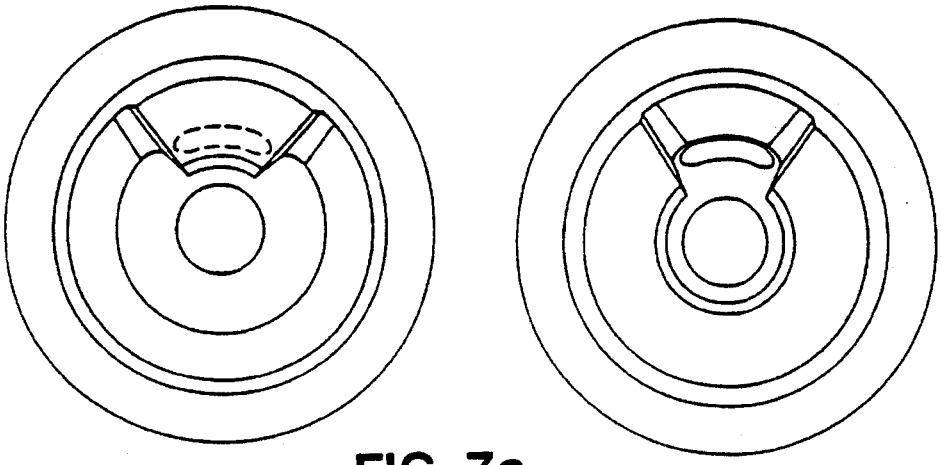
FIGS. 7A, 7B and 7C are plan views of three different configurations of outlet.
Figure 7B:
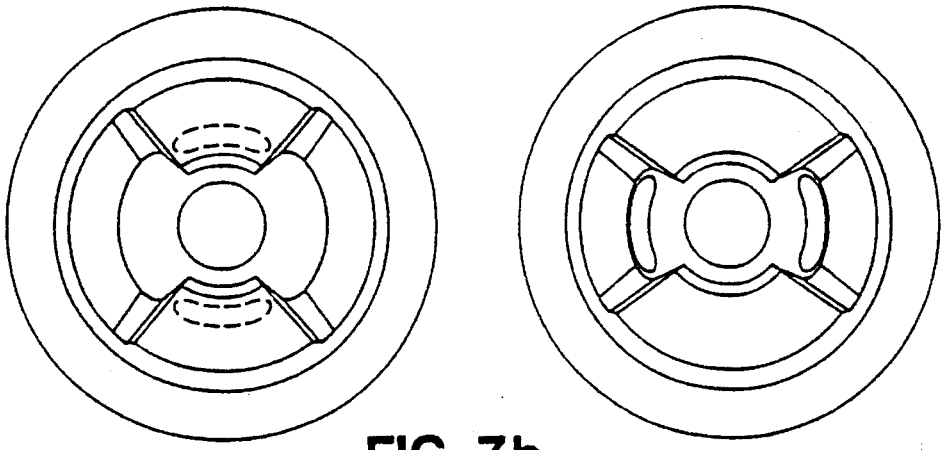
Figure 7C:
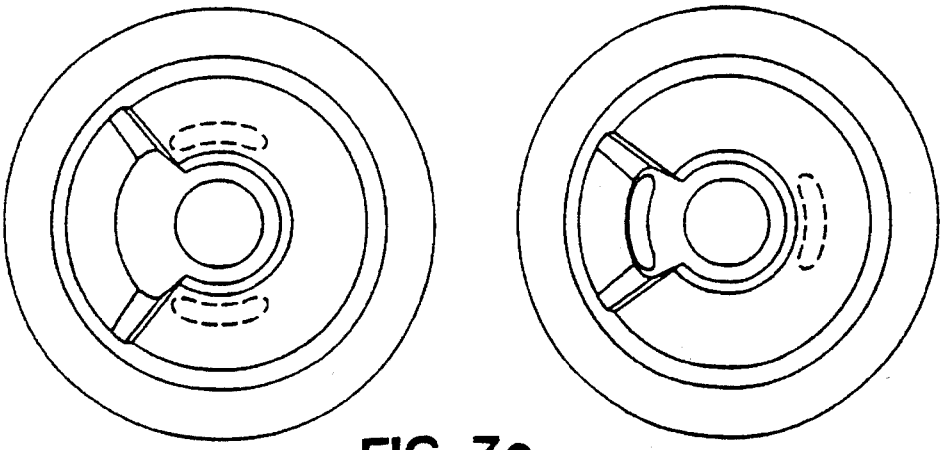

In the embodiment of FIG. 7A, the valve member 34 has a single inlet 44 and the high wall section may range across an arc of from 70° to 290°, corresponding to a length from 19% to 81% of the perimeter of the seating member 16. In the embodiment of FIG. 7B, the valve member 34 has two inlets 44 which are used together, and there are two second sections 46; the section 48 makes up from 38% to 62% of the perimeter of the seating member 16. In the embodiment of FIG. 7C, the valve member 34 has two inlets 44 but these are used individually and the first section 48 makes up from 69% to 81% of the length of the perimeter of the seating member 16.

Figure 8:
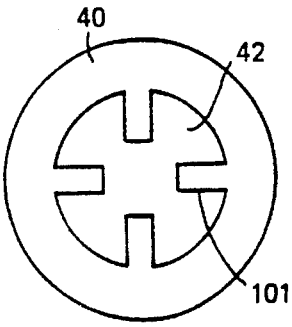
FIG. 8 is a transverse sectional view of the nozzle.

As can be seen in FIG. 8, four radially spaced apart ribs 101 are present in the passage 42. The ribs are straight sided, extend parallel to the longitudinal axis of the passage and are and spaced about 90° apart. By virtue of these ribs the stream of molten metal emerging from the passage is substantially parallel sided, so reducing the risk of splashing etc.

It will thus be seen that because the sealing faces of the valve member and the seating member therefor are shaped as illustrated the force required to turn the valve member is small and there is little chance of binding or jamming of the refractory parts. Also, the valve is designed so that there are no dead zones and molten solid has free access around the valve and is not trapped in blind alleys in which it could cool and solidify. As a result, the valve member may reliably be rotated without the risk of sticking of mating parts and causing freezing of molten metal which would stop relative rotation completely. Because of the ribs in the passage the flow of molten metal is coherent irrespective of the extent to which the valve is throttled.

The invention is not limited to the embodiments shown. For example there may be more than two inlets. The dimensions of the first and second sections may vary when the molten solid is other than steel poured in a foundry.

I claim:

1. A method of releasing molten metal from a vessel in a controlled manner, the vessel including a sidewall and a floor having a hole therein, and an outlet in the hole, the outlet including a rotary valve member rotatable about an axis of rotation, and a seating member for seating the valve member; the valve member and seating member having opposite mating surfaces, one of the opposite mating surfaces being convex in a plane including the axis of rotation, and the other being concave so as to minimize sticking between the surfaces; the valve member having a passage for conducting molten solid from inside of the vessel to outside the vessel including an inlet end having at least one inlet therein; the seating member having a wall which seals the passage inlet when aligned with the wall, the wall having a first section sufficiently high so that when the valve member is rotated so that the passage inlet is aligned therewith the inlet is sealed closed by the first section, and a second section having a lesser height than the first section and dimensioned so that when the valve member is rotated into alignment therewith the passage inlet is open to allow molten solid to pass into the passage from the vessel; and the second section providing the base of a generally open channel cross-sectional shape which allows molten solid from the vessel to move freely in the region of the second section when the passage inlet is closed, and the first section forming upstanding sidewalls which define opposite sides of the channel; said method comprising the steps of;

(a) placing molten metal into the vessel so that it covers the floor;

(b) rotating the valve member relative to the seating member to adjust the rate of flow of metal out of the vessel through the passage inlet, and then to close off the flow without causing sticking of the valve member to the seating member; and (c) directing the flow of molten metal in the passage to provide a flow stream having substantially parallel sides.

2. An outlet for a vessel containing a molten solid, said outlet comprising:

a rotary valve member rotatable about an axis of rotation, and a seating member for seating the valve member;

said valve member and seating member having opposite mating surfaces, one of said opposite mating surfaces being convex in a plane including said axis of rotation, and the other being concave, so as to minimize sticking between said surfaces;

said valve member having a passage for conducting molten solid from inside of the vessel to outside the vessel including an inlet end having at least one inlet therein;

said seating member having a wall which seals said passage inlet when aligned with said wall, said wall having a first section sufficiently high so that when said valve member is rotated so that said passage inlet is aligned therewith said inlet is sealed closed by said first section, and a second section having a lesser height than said first section and dimensioned so that when said valve member is rotated into alignment therewith said passage inlet is open to allow molten solid to pass into said passage from the vessel; and said second section providing the base of a generally open channel cross-sectional shape which allows molten solid from the vessel to move freely in the region of said second section when said passage inlet is closed, and said first section forming upstanding sidewalls which define opposite sides of said channel; wherein said opposite sidewalls defining said channel lie along planes which diverge away from said valve member; and further comprising four axially spaced apart radially extending ribs disposed in said passage and elongated in a dimension generally parallel to said axis of rotation.

3. An outlet for a vessel containing a molten solid, said outlet comprising:

a rotary valve member rotatable about an axis of rotation, and a seating member for seating the valve member;

said valve member and seating member having opposite mating surfaces, one of said opposite mating surfaces being convex in a plane including said axis of rotation, and the other being concave, so as to minimize sticking between said surfaces;

said valve member having a passage for conducting molten solid from inside of the vessel to outside the vessel including an inlet end having at least one inlet therein;

said seating member having a wall which seals said passage inlet when aligned with said wall, said wall having a first section sufficiently high so that when said valve member is rotated so that said passage inlet is aligned therewith said inlet is sealed closed by said first section, and a second section having a lesser height than said first section and dimensioned so that when said valve member is rotated into alignment therewith said passage inlet is open to allow molten solid to pass into said passage from the vessel; and said second section providing the base of a generally open channel cross-sectional shape which allows molten solid from the vessel to move freely in the region of said second section when said passage inlet is closed, and said first section forming upstanding sidewalls which define opposite sides of said channel; wherein said opposite sidewalls defining said channel lie along planes which diverge away from said valve member; and further comprising means disposed in said passage for causing the steam of molten solid leaving said outlet to be substantially parallel sided.

4. An outlet for a vessel containing a molten solid said outlet comprising;

a rotary valve member rotatable about an axis of rotation, and a seating member for seating the valve member;

said valve member and seating member having opposite mating surfaces, one of said opposite mating surfaces being convex in a plane including said axis of rotation, and the other being concave, so as to minimize sticking between said surfaces;

said valve member having a passage for conducting molten solid from inside of the vessel to outside the vessel including an inlet end having at least one inlet therein;

said seating member having a wall which seals said passage inlet when aligned with said wall, said wall having a first section sufficiently high so that when said valve member is rotated so that said passage inlet is aligned therewith said inlet is sealed closed by said fist section, and a second section having a lesser height than said fist section and dimensioned so that when said valve member is rotated into alignment therewith said passage inlet is open to allow molten solid to pass into said passage from the vessel; and said second section providing the base of a generally open channel cross-sectional shape which allows molten solid from the vessel to move freely in the region of said second when said passage inlet is closed, and said first section forming upstanding sidewalls which define opposite sides of said channel; and further comprising four axially spaced apart radially extending ribs disposed in said passage and elongated in a dimension generally parallel to said axis of rotation.

5. An outlet for a vessel containing a molten solid, said outlet comprising;

a rotary valve member rotatable about an axis of rotation, and a seating member for seating the valve member;

said valve member and seating member having opposite mating surfaces, one of said opposite mating surfaces being convex in a plane including said axis of rotation, and the other being concave, so as to minimize sticking between said surfaces;

said valve member having a passage for conducting molten solid from inside of the vessel to outside the vessel including an inlet end having at least one inlet therein;

said seating member having a wall which seals said passage inlet when aligned with said wall, said wall having a first section sufficiently high so that when said valve member is rotated so that said passage inlet is aligned therewith said inlet sealed closed by said first section, and a second section having a lesser height than said first section and dimensioned so that when said valve member is rotated into alignment therewith said passage inlet is open to allow molten solid to pass into said passage from the vessel; and said second section providing the base of a generally open channel cross-sectional shape which allows molten solid from the vessel to move freely in the region of said second section when said passage inlet is closed and said first section forming upstanding sidewalls which define opposite sides of said channel; and further comprising means disposed in said passage for causing the stream of molten solid leaving said outlet to be substantially parallel sided.

6. An outlet for a vessel containing a molten solid, said outlet comprising:

a rotary valve member rotatable about an axis of rotation, and a seating member for seating the valve member;

said valve member and seating member having opposite mating surfaces, one of said opposite mating surfaces being convex in a plane including said axis of rotation, and the other being concave, so as to minimize sticking between said surfaces;

said valve member having a passage for conducting molten solid from inside of the vessel to outside the vessel including an inlet end having at least one inlet therein;

said seating member having a wall which seals said passage inlet when aligned with said wall, said wall having a first section sufficiently high so that when said valve member is rotated so that said passage inlet is aligned therewith said inlet is sealed closed by said first section, and a second section having a lesser height than said first section and dimensioned so that when said valve member is rotated into alignment therewith said passage inlet is open to allow molten solid to pass into said passage from the vessel; and said second section providing the base of a generally open channel cross-sectional shape which allows molten solid from the vessel to move freely in the region of said second section when said passage inlet is closed, and said first section forming upstanding sidewalls which define opposite sides of said channel; wherein the height of said first section is from about 69–81% the height of said second section, and wherein said valve member has two inlets to said passage, disposed on opposite sides of said inlet end; and further comprising four axially spaced apart radially extending ribs disposed in said passage and elongated in a dimension generally parallel to said axis of rotation.

7. An outlet for a vessel containing a molten solid, said outlet comprising;

a rotary valve member rotatable about an axis of rotation, and a seating member for seating the valve member;

said valve member and seating member having opposite mating surfaces, one of said opposite mating surfaces being convex in a plane including said axis of rotation, and the other being concave, so as to minimize sticking between said surfaces;

said valve member having a passage for conducting molten solid from inside of the vessel to outside the vessel including an inlet end having at least one inlet therein;

said seating member having a wall which seals said passage inlet when aligned with said wall, said wall having a first section sufficiently high so that when said valve member is rotated so that said passage inlet is aligned therewith said inlet is sealed closed by said first section, and a second section having a lesser height than said first section and dimensioned so that when said valve member is rotated into alignment therewith said passage inlet is open to allow molten solid to pass into said passage from the vessel; and said second section providing the base of a generally open channel cross-sectional shape which allows molten solid from the vessel to move freely in the region of said second section when said passage inlet is closed, and said first section forming upstanding sidewalls which define opposite sides of said channel; wherein the height of said first section is from about 39–62% the height of said second section, and wherein said valve member has two inlets to said passage, disposed adjacent each other at said inlet end and being spaced apart less than the spacing between said opposite sidewalls defining said channel; and further comprising four axially spaced apart radially extending ribs disposed in said passage and elongated in a dimension generally parallel to said axis of rotation.

8. An outlet for a vessel containing a molten solid, said outlet comprising;

a rotary valve member rotatable about an axis of rotation, and a seating member for seating the valve member;

said valve member and seating member having opposite mating surfaces, one of said opposite mating surfaces being convex in a plane including said axis of rotation, and the other being concave, so as to minimize sticking between said surfaces;

said valve member having a passage for conducting molten solid from inside of the vessel to outside the vessel including an inlet end having at least one inlet therein;

said seating member having a wall which seals said passage inlet when aligned with said wall, said wall having a first section sufficiently high so that when said valve member is rotated so that said passage inlet is aligned therewith said inlet is sealed closed by said first section, and a section having a lesser height than said first section and dimensioned so that when said valve member is rotated into alignment therewith said passage inlet is open to allow molten solid to pass into said passage from the vessel; and said second section providing the base of a generally open channel cross-sectional shape which allows molten solid from the vessel to move freely in the region of said second section when said passage inlet is closed, and said first section forming upstanding sidewalls which define opposite sides of said channel; wherein the height of said first section is from about 19–81% the height of said second section, and wherein said valve member has a single inlet to said passage; and further comprising four axially spaced apart radially extending ribs disposed in said passage and elongated in a dimension generally parallel to said axis of rotation.

9. A vessel comprising;

a sidewall and a floor defining an interior volume;

a hole in said floor;

said hole having an outlet therein, said outlet comprising; a rotary valve member rotatable about an axis of rotation, and a seating member for seating the valve member; said valve member and seating member having opposite mating surfaces, one of said opposite mating surfaces being convex in a plane including said axis of rotation and the other being concave, so at to minimize sticking between said surfaces; said valve member having a passage for conducting molten solid from inside of the vessel to outside the vessel including an inlet end having at least one inlet therein; said seating member having a wall which seals said passage inlet when aligned with said wall, said wall having a first section sufficiently high so that when said valve member is rotated so that said passage inlet is aligned therewith said inlet is sealed closed by said first section, and a second section having a lesser height than said first section and dimensioned so that when said valve member is rotated into alignment therewith said passage inlet is open to allow molten solid to pass into said passage from the vessel; and said second section providing the base of a generally open channel cross-sectional shaped which allows molten solid from the vessel to move freely in the region of said second section when said passage inlet is closed, and said first section forming upstanding sidewalls which define opposite sides of said channel; and said second section having a top, and said top being approximately level with said floor of said interior volume; and further comprising four axially spaced apart radially extending ribs disposed in said passage and elongated in a dimension generally parallel to said axis of rotation.

* * * * *

UNITED STATES PATENT AND TRADEMARK OFFICE

CERTIFICATE OF CORRECTION

PATENT NO. : 5,603,859
DATED : February 18, 1997
INVENTOR(S) : WALLIS

It is certified that error appears in the above-indentified patent and that said Letters Patent is hereby corrected as shown below:

Column 2, line 11, replace "shade" with -- shape --.

Column 3, line 14, insert -- non-metallic material. [period] -- after "a".

Column 6, line 1, delete "and".

Column 7, line 57 (Claim 3, line 34), replace "steam" with -- stream --.

Column 8, line 9 (Claim 4, line 18), replace "fist" with -- first.

Column 8, line 11 (Claim 4, line 20), replace "fist" with -- first --.

Column 8, line 18 (Claim 4, line 27), insert --section -- after " second".

Column 8, line 41 (Claim 5, line 18), insert -- is -- before "sealed".

Column 10, line 39 (Claim 9, line 10), replace "at" with -- as --.

Signed and Sealed this

Twenty-fourth Day of June, 1997

Bruce Lehman

*Attest:*

BRUCE LEHMAN

*Attesting Officer*

*Commissioner of Patents and Trademarks*